US008444131B2

(12) United States Patent
Poiret et al.

(10) Patent No.: US 8,444,131 B2
(45) Date of Patent: May 21, 2013

(54) SHEET TRANSPORTING DEVICE, CUTTING DEVICE, PRINTING PRESS AND CORRESPONDING METHOD

(75) Inventors: François Poiret, Vineuil Saint Firmin (FR); Christophe Noiret, Saint Leu d'Esserent (FR); Alain Blanchard, Gouvieux (FR); Jean-François Robert, Creil (FR); François Vidaillac, Frocourt (FR); Nicolas Rousseau, Cinqueux (FR); Eric Pierda, Saint Leu d'Esserent (FR); Detlef Milkereit, Düsseldorf (DE)

(73) Assignees: Goss International Montataire SA, Montataire (FR); Vits Print GmbH, Langenfeld (DE)

( * ) Notice: Subject to any disclaimer, the term of this patent is extended or adjusted under 35 U.S.C. 154(b) by 0 days.

(21) Appl. No.: 12/990,614

(22) PCT Filed: Apr. 29, 2009

(86) PCT No.: PCT/FR2009/050795

§ 371 (c)(1),
(2), (4) Date: Feb. 17, 2011

(87) PCT Pub. No.: WO2009/138698

PCT Pub. Date: Nov. 19, 2009

(65) Prior Publication Data

US 2011/0133384 A1 Jun. 9, 2011

(30) Foreign Application Priority Data

Apr. 30, 2008 (FR) ..... 08 52926

(51) Int. Cl.
*B65H 39/00* (2006.01)

(52) U.S. Cl.
USPC ..... 270/52.09; 270/5.02; 270/52.07; 270/52.11; 270/52.14

(58) Field of Classification Search
USPC ..... 270/5.02, 5.03, 21.1, 43, 52.07, 52.09, 270/52.11, 52.14, 52.17, 52.19
See application file for complete search history.

(56) References Cited

U.S. PATENT DOCUMENTS

| | | | | |
|---|---|---|---|---|
| 4,946,151 | A * | 8/1990 | Liebert | 270/47 |
| 5,074,547 | A | 12/1991 | Smith et al. | 271/283 |
| 6,237,912 | B1 * | 5/2001 | Motooka et al. | 271/273 |
| 6,428,001 | B1 * | 8/2002 | Jackson | 271/270 |
| 2004/0017037 | A1 * | 1/2004 | Kawakami et al. | 271/114 |
| 2006/0244204 | A1 | 11/2006 | Bottger et al. | 271/183 |

* cited by examiner

FOREIGN PATENT DOCUMENTS

DE 10 2005 022240 A1 1/2006

OTHER PUBLICATIONS

Operating Instructions Cam Controller. Parker Hannifin GmbH EMD-Hauser. Offenburg, Germany D 77656. Nov. 1998.

*Primary Examiner* — Leslie A Nicholson, III
(74) *Attorney, Agent, or Firm* — Davidson, Davidson & Kappel, LLC

(57) ABSTRACT

The sheet transporting device of the invention includes: a transferring device (64) adapted to transfer a sheet (30), a conveying device (66; 66A) for conveying a sheet transferred from the transferring device (64) onto the conveying device, and a controlling means (76) adapted to control the speed of the conveying device (66; 66A) and defining a transfer cycle (CT). The controlling means (76) is adapted to slow down the conveying device (66) when a sheet is conveyed by the related conveying device and to accelerate the conveying device when no sheet is present on said conveying device. The invention can be used for the cutting devices of rotary printing machines.

22 Claims, 6 Drawing Sheets

SHEET TRANSPORTING DEVICE, CUTTING DEVICE, PRINTING PRESS AND CORRESPONDING METHOD

The present invention relates to a sheet transporting device.

BACKGROUND

Devices for transporting printed products such as sheets of paper are known in the prior art. These transporting devices are used, for example, in offset printing machines in order to transport the printed sheets.

These transporting devices comprise hollow conveyor rollers which have a transporting surface in contact with the sheet that is to be transported.

In order to cause the sheet to adhere to the conveyor roller, the transporting surface has cavities connected to a vacuum-creating device.

SUMMARY OF THE INVENTION

However, the printed sheet causes ink to be deposited on the transport surface and this results in poor production quality, particularly when the conveyor roller is a roller that decelerates the sheet.

An object of the present invention is to improve the quality of the printed products that can be produced by the printing machine, and to do so using simple means.

The present invention provides a transporting device wherein the control means are designed to slow the first conveying device when a sheet is being conveyed by the first conveying device concerned and accelerate the first conveying device concerned when there is no sheet on this conveying device.

According to some particular embodiments, the transporting device may include one or more of the following features:

- during a transfer cycle the first conveying device and the transfer device have a transfer phase in which a sheet is transferred onto the first conveying device and an output phase in which a sheet is set down by the first conveying device, and the control means are designed to accelerate the first conveying device between the output phase and the transfer phase and to slow the slowing device between the transfer phase and the output phase;
- the control means are designed to drive the first conveying device at a constant speed during the transfer phase and during the output phase;
- the control means are designed to drive the transfer device during the transfer phase at a first transfer speed and the conveying device at a second transfer speed which differs from the first transfer speed;
- the first transfer speed is higher than the second transfer speed;
- the first transfer speed is equal to the second transfer speed;
- the control means are designed to drive the transfer device at constant speed throughout an entire transfer cycle;
- the first conveying device is a slowing device designed to slow a sheet;
- the first conveying device is a conveyor, for example, a belt or chain conveyor;
- the control means comprise means for identifying the position of a conveying element of the conveying device and means for generating a conveying device speed setpoint signal dependent on the identified position, for example, electronic cam means;

- the transporting device comprises a second conveying device, the transfer device being designed to transfer a sheet onto each of the first and second conveying devices alternately;
- the transporting device comprises a cutting device designed to cut a web into sheets and to feed the transfer device with sheets; and
- the transfer cylinder is a counterpressure roller of the cutting device.

The present invention also provides a sheet output device comprising:

- a web input;
- a sheet stacking device; and
- a transporting device of the aforementioned type.

The invention also provides a web offset rotary press comprising an output device of the aforementioned type.

The present invention also provides a method of transporting sheets comprising the following steps during a transport cycle:

- transferring a sheet from a transfer device to a first conveying device;
- slowing the conveying device when there is a sheet placed on the conveying device; and
- accelerating the first conveying device when there is no sheet on the conveying device.

According to some particular implementations, the sheet transporting method may include one or more of the following features:

- during a transfer phase, transferring a sheet from the transfer device to the first conveying device at a transfer speed,
- during an output phase, the first conveying device setting down a sheet at an output speed lower than the transfer speed,
- between the transfer phase and the output phase, slowing the first conveying device, and
- between the output phase and the transfer phase, accelerating the first conveying device;
- during the transfer phase and/or during the output phase, the transporting method comprises the step of driving the first conveying device at a constant transfer and/or output speed;
- during the transfer phase, the transporting method comprises the step of driving the transfer device at a first transfer speed and the first conveying device at a second transfer speed;
- the first transfer speed is higher than the second transfer speed;
- the first transfer speed is equal to the second transfer speed; and
- before transferring the sheet, the transporting method comprises the step that consists in cutting the sheet from a web.

BRIEF DESCRIPTION OF THE DRAWINGS

The invention will be better understood from reading the description which will follow, given solely by way of example and made with reference to the attached drawings in which.

DETAILED DESCRIPTION

Figure 1:
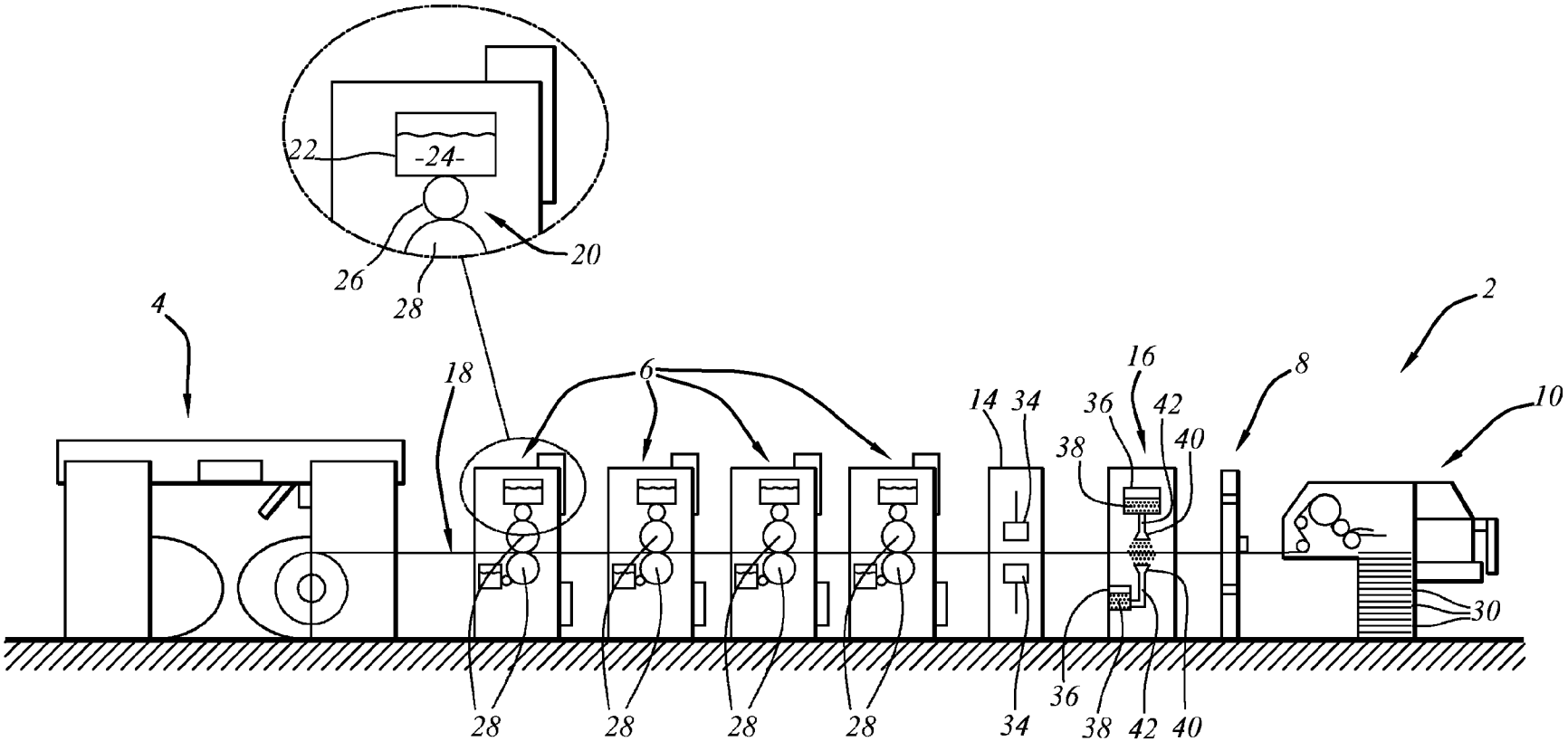
FIG. 1 is a schematic side view of a printing machine according to the invention.

FIG. 1 depicts a rotary printing machine according to the invention, denoted by the overall reference 2.

The printing machine 2 comprises an unwinder 4, four printing units 6, a traction device 8 and a cutting and stacking device 10. The printing machine 2 further comprises a web-gripping device 14 and a powdering device 16.

The printing machine 2 could comprise any number of printing units 6, in theory, from one to n.

The unwinder 4 is designed to unwind a continuous web 18 that is to be printed.

The web 18 for printing is a web of coated paper. Coated paper is a paper which has a layer of coating, for example of kaolin or chalk, that improves the mechanical or optical properties of the paper. This paper allows a high-quality printed product to be obtained. As an alternative, it is possible for the web that is to be printed to be a web of uncoated paper.

The printing machine 2 defines a printing path for the web 18 between the unwinder 4, through the printing units 6, the web-gripping device 14, the powdering device 16 and the traction device 8, as far as the cutting and stacking device 10.

Each printing unit 6 comprises an inking device 20 which is provided with an ink reservoir 22 containing ink 24 which is intended to be printed onto a web of paper 18. The ink 24 used in the context of the invention will be explained hereinbelow. Each inking device 20 further comprises an ink transfer roller 26 for transferring ink 24 to print rolls 28.

The printing units 6 comprise these print rolls 28 which are designed to print on the web of paper 18.

The cutting and stacking device 10 is designed to cut the web 18 that is to be printed into individual sheets 30 and to produce a stack of the cut individual sheets.

The traction device 8 is situated downstream of the most downstream printing unit 6 and upstream of the cutting and stacking device 10. This traction device 8 is designed to apply a set mechanical tension to the web 18 leaving the most downstream printing unit 6.

As shown in FIG. 1, the printing machine 2 is designed to transport the printed web 18 suspended freely and exposed to the ambient air throughout the path between the most downstream printing unit 6 and the traction device 8, with the possible exception of the web-gripping device 14 and the powdering device 16. Further, the printing machine 2 is also designed to transport the printed web 18 exposed to the ambient air throughout the path between the traction device 8 and the cutting and stacking device 10. Thus, the printing machine 2 of FIG. 1 has no drier and occupies only a small amount of space.

Figure 2:
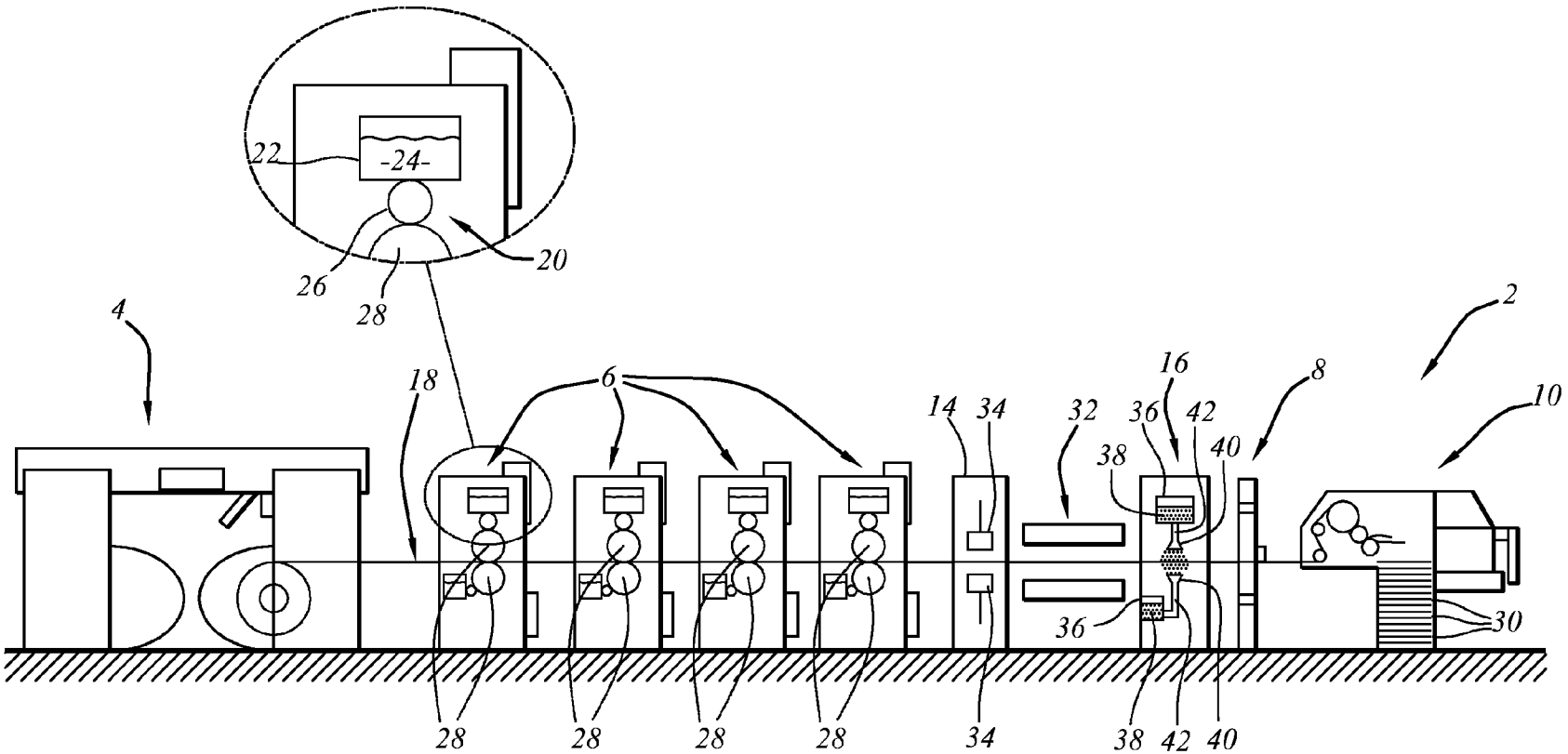
FIG. 2 is a view corresponding to the view of FIG. 1, but of an alternative form of a printing machine according to the invention.

The printing machine 2 according to the alternative form shown in FIG. 2 differs from the printing machine 2 shown in FIG. 1 in that between the web-gripping device 14 and the traction device 8 there is an infrared drier 32 through which the printed web 18 is conveyed. The infrared drier 32 may be replaced by some other device that dries the web by heating, such as a hot air drier. The drier 32 is small in size by comparison with the driers of the prior art.

The web-gripping device 14 is designed to detect a break in the web of paper 18 and to grip hold of the free end of the web of paper 18 if this occurs. To do that, the web-gripping device 14 comprises appropriate gripper elements 34. As an alternative, the web-gripping device 14 may be omitted.

The powdering device 16 is designed to apply anti-offset powder to each of the sides of the printed web 18. It may apply anti-offset powder to one or both sides of the printed web 18. To do this, the powdering device 16 comprises a reservoir 36 containing powder 38 and a powdering head 40 connected to the powder reservoir 36 by a pipe 42, for each of the sides of the web of paper 18.

The powdering device 16 is designed to apply the anti-offset powder to the web of paper 18 continuously, preferably continuously and uninterrupted over a length that corresponds to at least twice the print length.

The powder 38 used for powdering the web is preferably a vegetable powder based on cornstarch, or a mineral powder.

The traction device 8 associated with the other units of the press allows a web of paper to be printed and received in the cutting and stacking device 10 without drying this web of paper 12 and by evaporating the solvents from the ink.

The image is printed using the ink 24 contained in the ink reservoir 22. Advantageously, the ink 24 is a siccative ink, or a "waterless" ink, or a two-part ink. The way in which siccative inks dry is a combination of a first phenomenon known as "penetration into the medium" and of a second phenomenon known as "oxidative polymerization of the oil and resin lacquers".

Waterless inks are used with special-purpose impression plates that make it possible to define non-printing zones without resorting to the conventional lithographic method based on a pre-moistened hydrophilic surface repelling an oily ink. The use of these inks may be forseen as well as in addition to conventional siccative inks seen hereinabove, and this means that a drier can be dispensed with, or at least designed less bulky.

Heat-set inks on the other hand dry through the evaporation of the mineral solvents mixed in with the resin. UV inks are dried by the polymerization of the resin under the effect of ultraviolet irradiation.

Figure 3:
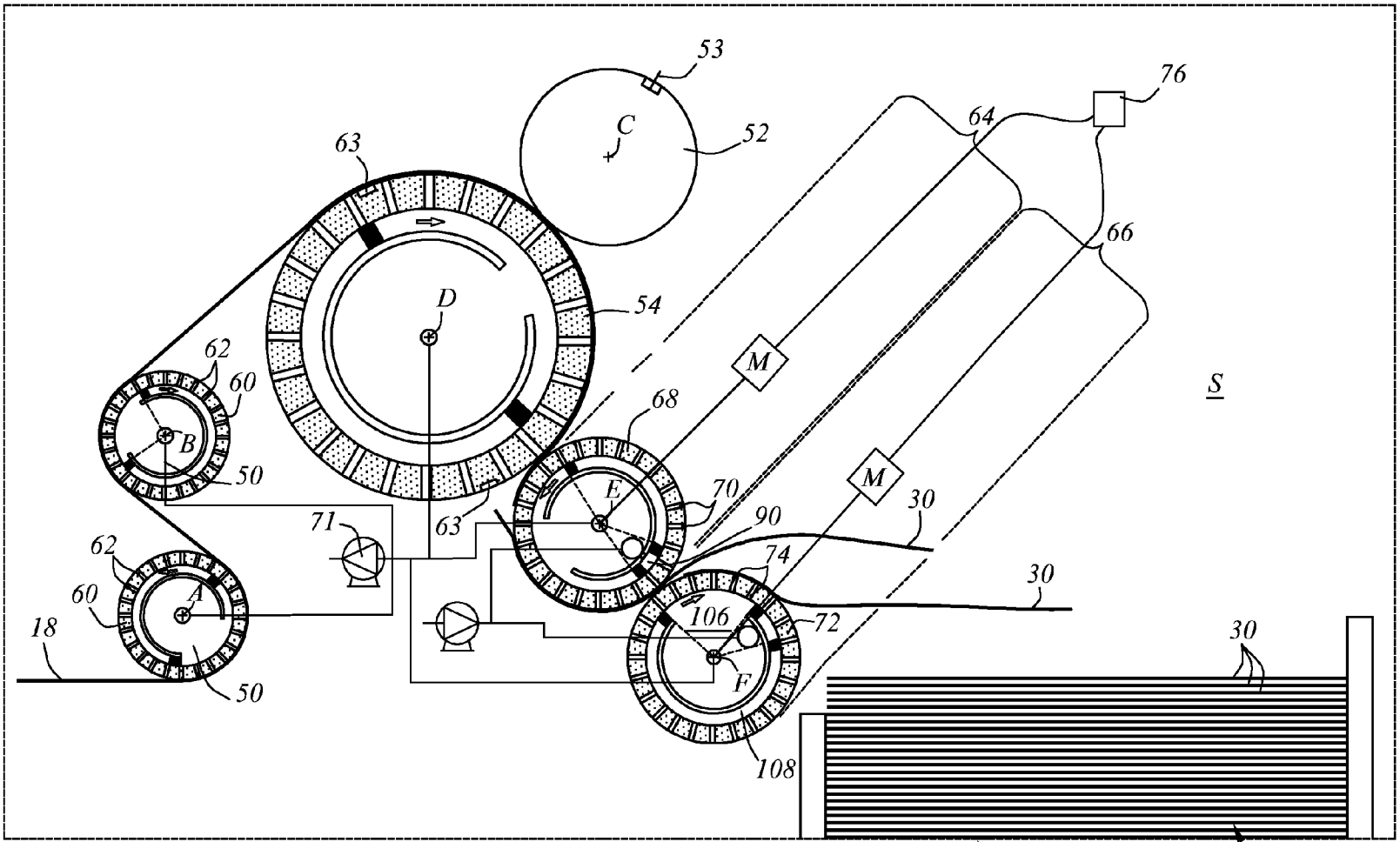
FIG. 3 is a schematic view of the cutting and stacking device according to a first embodiment.

FIG. 3 schematically depicts the cutting and stacking device 10.

The cutting and stacking device 10 comprises two input rollers 50, a cutting cylinder 52 and a counterpressure roller 54.

The cutting and stacking device 10 comprises a fixed structure S or stand.

The input rollers 50 are positioned upstream of the cutting cylinder 52 and of the counterpressure roller 54. The two input rollers 50 are able to rotate about an axis A and B with respect to the fixed structure S. Each of the input rollers 50 has a shell 60 with through-holes 62.

The cutting cylinder 52 comprises a blade 53 and rotates about an axis C.

The counterpressure roller 54 is able to rotate about an axis D and comprises counterpressure blocks 63 which collaborate with the blade 53 to cut the web of paper into sheets 30.

The cutting and stacking device 10 comprises a transfer device 64 and a conveying device 66.

The transfer device 64 is designed to pick up a sheet 30 from the counterpressure roller 54 and transfer it to the conveying device 66.

The transfer device 64 comprises a transfer cylinder 68 able to rotate about an axis E. The transfer cylinder 68 comprises openings 70.

The conveying device 66 comprises a conveying cylinder 72 able to rotate about an axis F. The conveying cylinder 72 comprises openings 74.

The cutting device 10 also comprises a suction device 71 designed to create suction in the openings 70, 74.

The cutting device 10 delimits a path for the web of paper 18 and the sheets 30 running from the input to this device 10 through, in succession, the input rollers 50, a counterpressure roller 54, the transfer cylinder 68, the conveying cylinder 72 as far as a stack 31 of individual sheets 30.

The cutting device 10 comprises control means, for example, a controller 76 designed to control the speed V66 of the conveying device 66 and the speed V64 of the transfer device 64. The controller 76 defines a transfer cycle for the transferring of a sheet 30. A transfer cycle is, for example, one full revolution of the transfer cylinder.

When a sheet 30 is being conveyed by the conveying device 66, the control means 76 are designed to slow this conveying device 66. When there is no sheet 30 on the conveying device, the controller 76 is designed to accelerate the conveying device 66.

Figure 4:
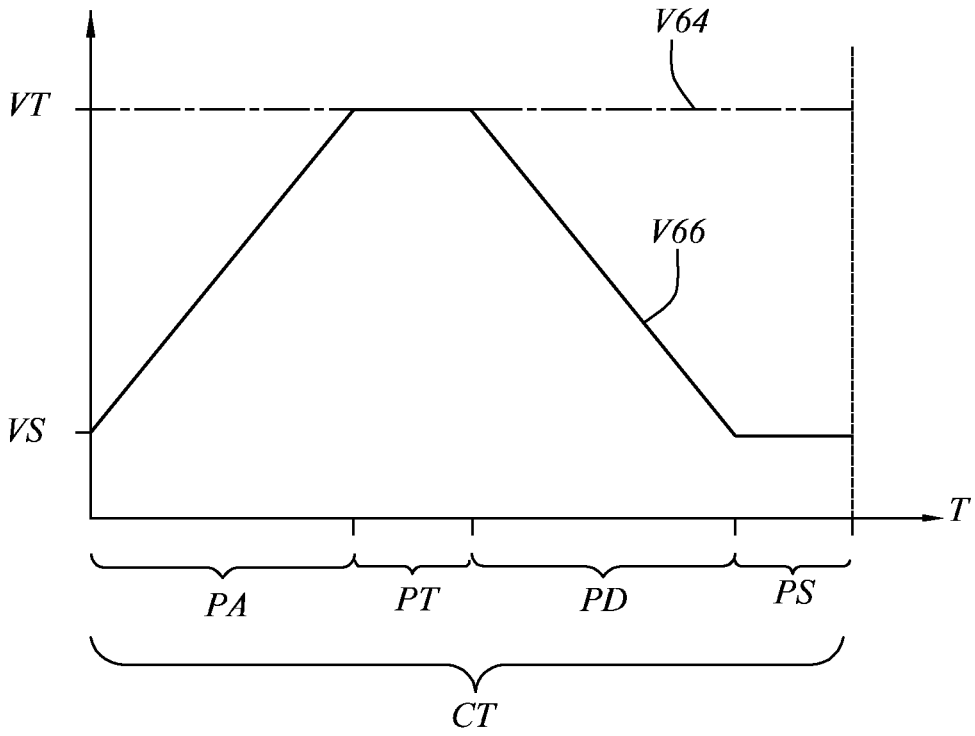
FIGS. 4 and 5 are diagrams showing the speeds of operation of the transfer device and of the conveying device according to a first and a second mode of operation of the cutting device.

FIG. 4 depicts a transfer cycle CT of the cutting device 10.

The abscissa axis shows the time T in a transfer cycle, therefore one rotation of the transfer cylinder 68 through 360°. The ordinate axis shows the speed V64 of the transfer device 64 and the speed V66 of the conveying device 66.

Thus, in a transfer cycle CT, the transfer device 64 and the conveying device 66 have a transfer phase PT in which a sheet 30 that is on the transfer cylinder 68 is transferred from the transfer device 64 onto the conveying device 66, and an output phase PS in which the sheet 30 is set down on the stack 31 by the conveying device 66. Furthermore, after the transfer phase PT and before the output phase PS of the same cycle, there is a deceleration phase PD during which the conveying device 66 is decelerated. Also, after the output phase PS and before the transfer phase PT of the same cycle, there is an acceleration phase PA during which the conveying device 66 is accelerated.

In other words, the controller 76 is designed to accelerate the conveying device 66 between the output phase PS and the transfer phase PT and to slow the conveying device 66 between the transfer phase PT and the output phase PS of the same cycle.

The controller 76 is designed to drive the conveying device 66 at a constant speed V66 during the transfer phase PT and during the output phase PS. During the output phase PS, the conveying device 66 is driven at an output speed VS.

Likewise, the controller 76 is designed to drive the transfer device 64 at a constant speed V64 throughout an entire transfer cycle. In particular, during the transfer phase PT, the speed V64 and the speed V66 are identical to a transfer speed VT.

Figure 5:
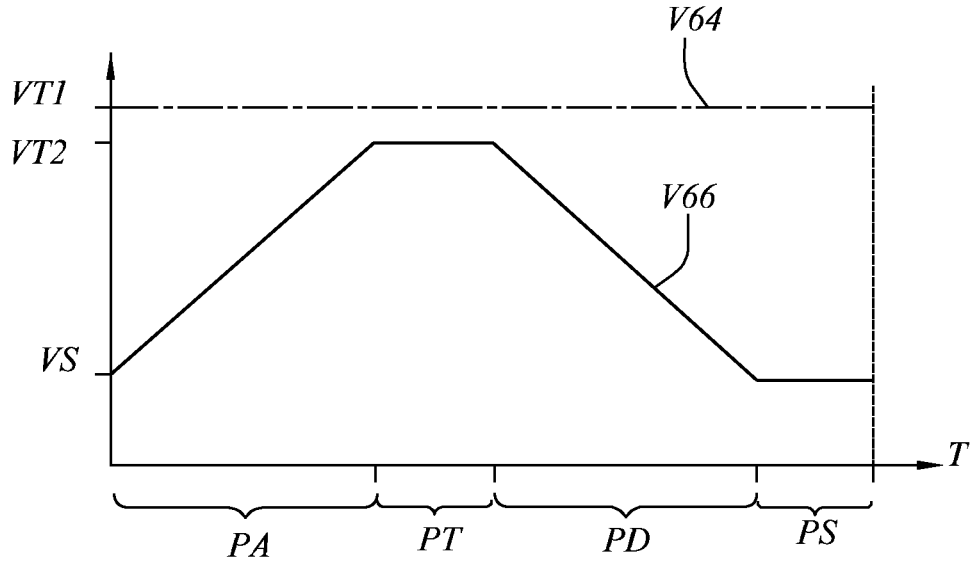

FIG. 5 depicts an alternative form of the transfer cycle. In this alternative form, the controller 76 is designed so that, during the transfer phase PT, the transfer device 64 is driven at a first transfer speed VT1 and the conveying device 66 is driven at a second transfer speed VT2.

The speed V64 of the transfer device 64 is, throughout one and the same cycle, higher than the speed V66 of the conveying device 66. Thus, the first transfer speed is higher than the second transfer speed.

In particular, the conveying device 66 is a slowing device designed to slow a sheet. Thus, the conveying cylinder is a slowing cylinder.

The controller 76 preferably includes a device, for example, an electronic cam 176 (FIG. 6) for employing ECAM (that is to say electronic cam) technology. The controller is therefore designed to control the speed of each of the transfer 64 or conveying 66 devices according to the position of the conveying element of this device. The conveying element is either a cylinder, for example the cylinder 68, or a belt or band.

When the conveying element is a cylinder, the controller 76 is designed to identify the angular position of the cylinder and to control the speed according to this position. The controller advantageously comprises a processor connected to a sensor that senses the angular position of the cylinder and a memory connected to the processor. The memory contains information that allows the angular position information to be converted into information representing a speed setpoint for the corresponding cylinder. The processor has means of transmitting the speed setpoint to a speed regulator.

Figure 6:
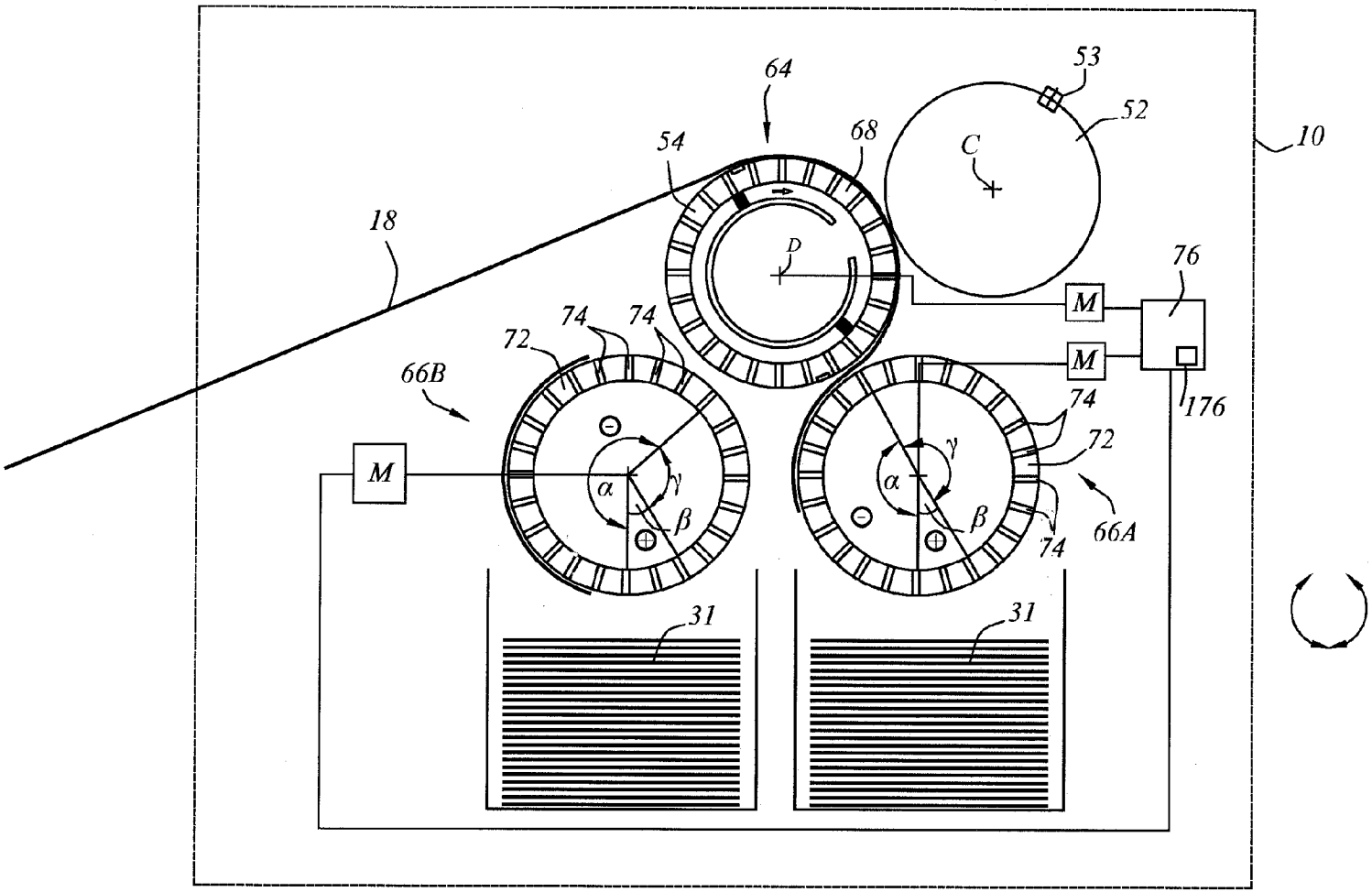
FIG. 6 is a schematic view corresponding to the view of FIG. 3 but of a second embodiment of the cutting and stacking device according to the invention.

FIG. 6 depicts a schematic view of a second embodiment of the cutting and stacking device 10 according to the invention.

In what follows, only differences by comparison with the first embodiment will be explained. Elements that are analogous bear the same references.

This cutting and stacking device 10 comprises a cutting cylinder 52 and a counterpressure roller 54. The transfer device 64 comprises the counterpressure roller 54 such that the transfer cylinder 68 consists of the counterpressure roller.

Moreover, the transporting device comprises a first 66A and a second 66B conveying device, each of which is a slowing device. The counterpressure roller 54 is therefore designed to feed each of the first 66A and second 66B conveying devices directly.

Each conveying device 66A, 66B comprises a conveying cylinder 72. Each cylinder 72 has openings 74.

Each of the first conveying device 66A and second conveying device 66B comprises a reduced-pressure chamber extending over a first angular field $\alpha$ and a raised-pressure chamber extending over a second angular field $\beta$.

Each of the conveying devices 66A, 66B comprises an ambient chamber extending over a third angular field $\gamma$.

Each of the chambers is connected to the openings 74 in the corresponding angular field.

The controller 76 is designed to control the speed of each of the conveying devices 66A and 66B and that of the transfer device 64.

The transfer device 64 is designed to transfer a sheet 30 onto one 66A and the other 66B of the conveying devices alternately.

The transporting device defines a transfer cycle which consists of the transfer of two successive sheets 30.

Figure 7:
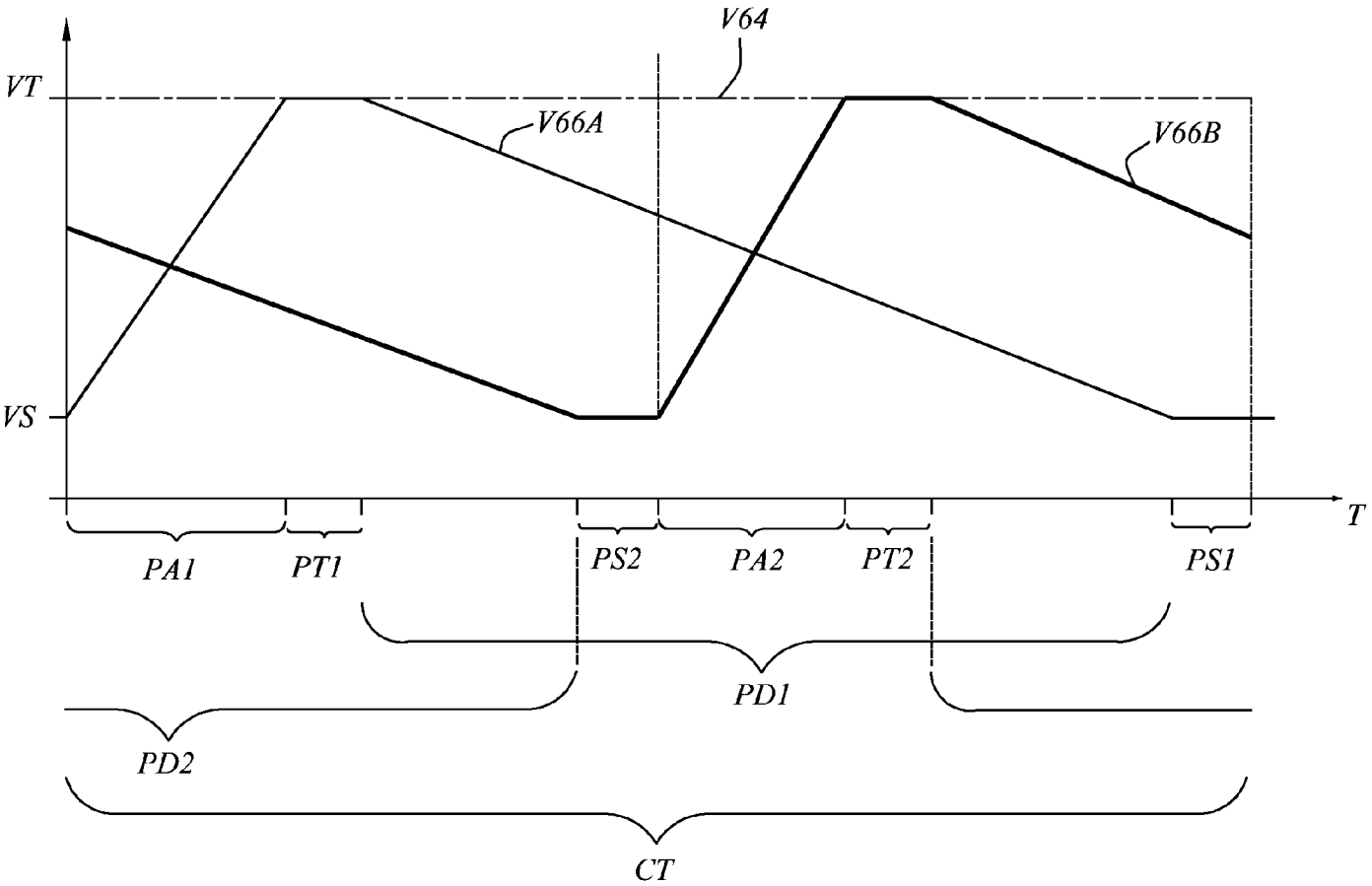
FIG. 7 is a diagram showing the speeds of operation of the transfer device and of the conveying devices during the operation of the cutting device according to the second embodiment.

FIG. 7 is a diagram showing the operating speeds of the transfer device 64 and of the conveying devices 66A, 66B during operation of the cutting device according to the second embodiment.

The abscissa axis shows the time T in a transfer cycle CT. The ordinate axis shows the speed V64 of the transfer device 64, the speed V66A of the first conveying device 66A and the speed V66B of the second conveying device 66B.

Over a transfer cycle CT, the first conveying device 66A and the transfer device 64 have a transfer phase PT1 in which a sheet 30 is transferred from the transfer device 64 onto the first conveying device 66A, and an output phase PS1 in which a sheet 30 is set down by the first conveying device 66A onto the first stack 31 of sheets.

Further, after the transfer phase PT1 and before the output phase PS1 of the same cycle, there is a deceleration phase PD1. Also, after the output phase PS1 and before the transfer phase PT1 of the same cycle, there is an acceleration phase PA1 of the first conveying device. Unlike in the first embodiment, the acceleration phase PA1 is shorter than the deceleration phase PD1. Thus, the sheet 30 is slowed with a relatively low deceleration, limiting the marking on the paper.

Also, over a transfer cycle CT, the second conveying device 66B and the transfer device 64 have a transfer phase PT2 in which a sheet 30 is transferred from the transfer device 64 onto the second conveying device 66B and an output phase PS2 in which a sheet 30 is set down by the second conveying device 66B onto the second stack 31 of sheets.

Further, after the transfer phase PT2 and before the output phase PS2 of the same cycle there is a deceleration phase PD2 of the second conveying device 66B. Also, after the output phase PS2 and before the transfer phase PT2 of the same cycle, there is an acceleration phase PA2 of the second conveying device 66B. Unlike in the first embodiment, the acceleration phase PA2 is shorter than the deceleration phase PD2. Thus, the sheet 30 is slowed with a relatively low deceleration, limiting the marking on the paper.

Feeding the two conveying devices 66A, 66B alternately also allows the sheets to be slowed with a low deceleration for a given sheet production rate.

During the transfer phases PT1 and PT2 and during the output phases PS1 and PS2, the controller 76 is designed to drive the conveying devices 66A, 66B at a constant transfer speed VT and a constant output speed VS.

By way of an alternative that has not been depicted, the conveying device 66, 66A, 66B is a conveyor, notably a belt or chain conveyor. In this case, the conveying device has no cylinder.

The term "speed" means the speed of the element in contact with the sheet 30. In the case of the transfer cylinder 68, the speed is the circumferential speed of this transfer cylinder. In the case of the conveying cylinder 72, the speed is the circumferential speed of this conveying cylinder. When the transfer and/or conveying devices comprise conveyor belts, the corresponding speed is the speed of the belt.

In general, a transfer cycle is the time that elapses between a given configuration of the transfer device and of the conveying device.

The invention claimed is:

1. A sheet transporting device comprising:

a transfer device transferring a sheet;

a first conveying device conveying a sheet transferred from the transfer device onto the first conveying device;

a controller controlling the speed of the first conveying device and defining a transfer cycle, the controller slowing the first conveying device when a sheet is being conveyed by the first conveying device, the controller including a device for identifying the position of a conveying element of the conveying device and generating a conveying device speed setpoint signal dependent on the identified position; and accelerating the first conveying device when there is no sheet on the first conveying device.

2. The transporting device as recited in claim 1, wherein during a transfer cycle, the first conveying device and the transfer device have a transfer phase in which a sheet is transferred onto the first conveying device and an output phase in which a sheet is set down by the first conveying device, and the controller accelerating the first conveying device between the output phase and the transfer phase and slowing a slowing device between the transfer phase and the output phase.

3. The transporting device as recited in claim 2, wherein the controller drives the first conveying device at a constant speed during the transfer phase and during the output phase.

4. The transporting device as recited in claim 2, wherein the controller drives the transfer device during the transfer phase at a first transfer speed and the conveying device at a second transfer speed which differs from the first transfer speed.

5. The transporting device as recited in claim 4, wherein the first transfer speed is higher than the second transfer speed.

6. The transporting device as claimed in claim 4, wherein the first transfer speed is equal to the second transfer speed.

7. The transporting device as recited in claim 1, wherein the controller drives the transfer device at a constant speed throughout an entire transfer cycle.

8. The transporting device as recited in claim 1, wherein the first conveying device is a slowing device that slows a sheet.

9. The transporting device as recited in claim 1, wherein the first conveying device is a conveyor.

10. The transporting device as recited in claim 1, further comprising a second conveying device, the transfer device transferring a sheet onto each of the first and second conveying devices alternately.

11. The transporting device as recited in claim 1, further comprising a cutting device cutting a web into sheets and feeding the transfer device with sheets.

12. The transporting device as recited in claim 11, wherein the transfer device is a counterpressure roller of the cutting device.

13. A sheet output device comprising:

a web input;

a sheet stacking device; and a transporting device as recited in claim 11.

14. A web offset rotary press comprising an output device as claimed in claim 13.

15. A method of transporting sheets with the sheet transporting device recited in claim 1 comprising the following steps during a transport cycle:

transferring a sheet from the transfer device to the first conveying device;

slowing the first conveying device when there is a sheet placed on the first conveying device; and accelerating the first conveying device when there is no sheet on the first conveying device.

16. The transporting method as claimed in claim 15, further comprising the following steps:

during a transfer phase, transferring a sheet from the transfer device to the first conveying device at a transfer speed;

during an output phase, the first conveying device setting down a sheet at an output speed lower than the transfer speed;

between the transfer phase and the output phase, slowing the first conveying device; and between the output phase and the transfer phase, accelerating the first conveying device.

17. The transporting method as recited in claim 16, comprising, during the transfer phase or during the output phase, the step of driving the first conveying device at a constant transfer or output speed, respectively.

18. The transporting method as recited in claim 17, comprising, during the transfer phase, the step of driving the transfer device at a first transfer speed and the first conveying device at a second transfer speed.

19. The transporting method as claimed in claim 18, wherein the first transfer speed is higher than the second transfer speed.

20. The transporting method as claimed in claim 18, wherein the first transfer speed is equal to the second transfer speed.

21. The transporting method as recited in claim 15, comprising, prior to transferring the sheet, the step of cutting the sheet from a web.

22. The transporting device as recited in claim 1, wherein the device identifying the position of a conveying element and generating a conveying device speed setpoint signal depending on the identified position is an electronic cam.

* * * * *